US007255198B1

(12) United States Patent
Lo

(10) Patent No.: US 7,255,198 B1
(45) Date of Patent: Aug. 14, 2007

(54) TRIPOD EXTENSION STEPLADDER

(76) Inventor: Jennhwa Alan Lo, 2050 Chancery Ave., Troy, MI (US) 48085

( * ) Notice: Subject to any disclaimer, the term of this patent is extended or adjusted under 35 U.S.C. 154(b) by 338 days.

(21) Appl. No.: 10/972,925

(22) Filed: Oct. 25, 2004

(51) Int. Cl.
*E06C 1/00* (2006.01)
*E06C 7/00* (2006.01)

(52) U.S. Cl. ..... 182/172; 182/200

(58) Field of Classification Search ..... 182/200, 182/201, 202, 165, 166, 167, 168, 169, 170, 182/171, 172, 173, 174–176, 106
See application file for complete search history.

(56) References Cited

U.S. PATENT DOCUMENTS

| | | | | |
|---|---|---|---|---|
| 46,106 | A | 1/1865 | Hayes | |
| 534,463 | A | 2/1895 | Bowser | |
| 1,192,734 | A * | 7/1916 | Bennett | 182/166 |
| 1,331,953 | A * | 2/1920 | Brown | 182/175 |
| 1,670,653 | A | 5/1928 | Cummins | |
| 2,650,014 | A * | 8/1953 | Harrison | 182/170 |
| 2,997,127 | A | 8/1961 | Wojtowicz | |
| 3,508,628 | A | 4/1970 | Conrad | |
| 3,856,112 | A | 12/1974 | Stewart | |
| 4,249,637 | A * | 2/1981 | Glasgow | 182/170 |
| 4,433,754 | A | 2/1984 | Beach | |
| 4,798,262 | A | 1/1989 | Margolies | |
| 5,590,739 | A | 1/1997 | High et al. | |
| 6,533,071 | B1 | 3/2003 | Smith | |

FOREIGN PATENT DOCUMENTS

| | | |
|---|---|---|
| EP | 0.039.078 | 4/1981 |
| WO | WO00/32900 | 6/2000 |

* cited by examiner

*Primary Examiner*—Hugh B. Thompson, II
(74) *Attorney, Agent, or Firm*—Michael I Kroll

(57) ABSTRACT

The present invention 10 discloses a stepladder having a ladder portion 18 that is comprised of rungs 24 and includes two ladder side rails, and a support portion that includes two angularly disposed telescoping legs 20 that provide mechanism for stabilizing the ladder. The telescoping support legs 20 are interconnected to each other and to the ladder side rails by lockable rigid spanner arms 22. When in use, the spanner arms 22 are locked in an open position to form a tripod formation between the rails while additionally limiting the angle of spread between the ladder portion 18 and the support legs 20. The present invention 10 also provides a retractable fly assembly 26 at the top of the ladder rails to provide for additional usable working height. A safety belt 36 is provided on the handle for additional support. A series of apertures with lock key fasteners 28 in each of the support legs provide mechanism for the user to securely position the legs at a desired length. The lock key fastener 28 includes a locking pin that engages an aperture in the corresponding leg to secure the desired position.

12 Claims, 10 Drawing Sheets

TRIPOD EXTENSION STEPLADDER

BACKGROUND OF THE INVENTION

1. Field of the Invention

The present invention relates generally to ladders and, more specifically, to an extension stepladder with tripod forming support rails. The three legs of the tripod are the two support rails and the ladder which is described as one leg.

The stepladder of the present invention consists of a ladder portion that is comprised of rungs and includes two ladder side rails, and a support portion that includes two telescoping rails that provide means for stabilizing the ladder.

The telescoping support rails are interconnected to each other and to the ladder side rails by lockable rigid spanner arms. When in use, the spreader arms are locked in an open position providing means to form a tripod formation between the rails while additionally limiting the angle of spread between the ladder rails and the support rails.

When not in use, the spanner arms are pivotally rotated to allow the support legs to close and retract toward the ladder rails forming a compact and transportable ladder assembly.

The tripod style extension stepladder of the present invention provides means for improved safety, increased capability and convenience. The tripod legs maximize the base spans of the stepladder by extending divergently from the ladder portion creating a large base support. The higher the ladder extension the larger the base spans on the floor so that the user does not have to compromise the stability at any elevation setting. Each of the support rails is independently telescopic to allow for use on uneven surfaces.

Additionally, the stepladder of the present invention also provides a retractable support rail at the top of the ladder rails to provide means for additional usable working height. Since the user can easily place themselves out of balance when both hands are off of the stepladder creating a safety hazard, a safety belt is provided on the handle for additional support.

The tripod stepladder of the present invention provides extendable retractable support legs having rigid spanners forming a tripod structural support member to prevent movement of the legs relative to each other when in the extended position. Furthermore, additional safety features are incorporated comprising telescopic support legs for use on an uneven base surface, an extendable hand rail at the top of the ladder and a safety belt, with both providing safety and a secure working environment for the user.

A series of apertures with lock key fasteners in each of the support legs provide means for the user to securely position the legs at a desired length. The lock key fastener includes a locking pin that engages an aperture in the corresponding leg to secure the desired position.

2. Description of the Prior Art

There are other extension ladders and stepladders that provide improved stabilization. Typical of these is U.S. Pat. No. 46,105 issued to Hayes on Jan. 31, 1865.

Another patent was issued to Bowser on Feb. 19, 1895 as U.S. Pat. No. 534,463. Yet another U.S. Pat. No. 1,670,653 was issued to Cummins on May 22, 1928 and still yet another was issued on Aug. 22, 1961 to Wojtowicz as U.S. Pat. No. 2,997,127.

Another patent was issued to Conrad on Apr. 28, 1970 as U.S. Pat. No. 3,508,628. Yet another U.S. Pat. No. 3,856,112 was issued to Stewart on Dec. 24, 1974. Another was issued to Beach on Feb. 28, 1984 as U.S. Pat. No. 4,433,754 and still yet another was issued on Jan. 17, 1989 to Margolies as U.S. Pat. No. 4,798,262.

Another patent was issued to High, et al. on Jan. 7, 1997 as U.S. Pat. No. 5,590,739. Yet another U.S. Pat. No. 6,533,071 issued on Mar. 18, 2003 to Smith. Another European Patent was issued to Klenk on Apr. 27, 1981 as EP0039078. WIPO Patent Publication No. WO 00/32900 was filed by Laug and published on Jun. 8, 2000.

U.S. Pat. No. 46,105

Inventor: Casson Hayes

Issued: Jan. 31, 1865

This invention relates to a fruit ladder construction whereas a back brace with a single foot, instead of two feet, as commonly seen in stepladders. Two pieces are hinged at the top and joined at the lower end forming a "V". Two side braces hinged at the top provide stabilization.

U.S. Pat. No. 534,463

Inventor: Allen A. Bowser

Issued: Feb. 19, 1895

The object of this invention is to improve the construction of extension step ladders, and to provide a simple and inexpensive one, which will be strong and durable, and in which the parts may be readily assembled. The invention consists in the construction and novel combination and arrangement of parts hereinafter fully described, illustrated in the accompanying drawings, and pointed out in the claim hereto appended.

U.S. Pat. No. 1,670,653

Inventor: Charles F. Cummins

Issued: May 22, 1928

This invention relates to improvements in stepladders, of the propped type, wherein the ladder structure is made up of a step-section and a hinged prop-section, both of which sections in turn are composed of relatively movable or extensible parts, and provided with means for holding the respective extensible parts in adjusted position.

U.S. Pat. No. 2,997,127

Inventor: Michael Wojtowicz

Issued: Aug. 22, 1961

This invention relates to a stepladder with improved stabilizing legs. The stepladder has improves hingedly mounted legs which swing out from the vertical sides of the leg-frames of the ladder and function as stabilizing props, that is, prevent the ladder from toppling over and subjecting the user to possible injury.

U.S. Pat. No. 3,508,628

Inventor: Charles J. Conrad

Issued: Apr. 28, 1970

A laterally extending telescopic stabilizing brace for a ladder including upper and lower ratchet controlled sections, the upper section being pivotally engaged with a side rail of a ladder for a swinging of the brace between a collapsed clamp held position against the side rail and extended outwardly moved bracing position. An adjustable hinge-type connector is used to mount the upper end of the brace to the ladder side rail regardless of variations in the width of the side, a similar hinge-type connector being utilized in securing a folding brace bar.

U.S. Pat. No. 3,856,112

Inventor: Arthur H. Stewart

Issued: Dec. 24, 1974

A stabilizer bar at each side of a ladder is connected at one end thereto by a universal connection and at its other end, the stabilizer bar terminates in a foot pad for ground engagement, to stabilize the ladder when in use. Each stabilizer bar is adjustable as to length to compensate for ground irregularities, the adjustability being accomplished by forming each bar of a pair of members, one member sliding along the other on a substantially three line contact to minimize jamming. A vertically adjustable hand hold, mountable at the upper end of the ladder, enables the individual to steady himself while working on the ladder, while the ladder itself is stabilized.

U.S. Pat. No. 4,433,754

Inventor: John Beach

Issued: Feb. 28, 1984

An improved stabilizer assembly for use with stepladders comprises a board member capable of being secured to the top platform of the stepladder; first and second hinges associated with the board member at or near opposing lateral ends of the board member; and first and second support legs associated with first and second hinges, respectively, and being capable of extending from the secured board member to improve the stability of the ladder.

U.S. Pat. No. 4,798,262

Inventor: Paul Margolies

Issued: Jan. 17, 1989

This invention relates to tripodal support structures and more particularly to a three-legged folding step-ladder having outrigger-type support extensions on the two front support legs, a rear support member having a single ground contact point, and independently extendable and retractable safety hand rails. The support legs of the instant invention contact the ground at points spaced apart from one another to form an equilateral triangle when viewed from above.

U.S. Pat. No. 5,590,739

Inventor: DeWayne A. High

Issued: Jan. 7, 1997

A motorized utility extension ladder having a main and upper riser section extendable by a motor. The ladder further comprising a telescopic prop so that the ladder may be free standing, side wing legs for stabilizing the ladder, wheels for transporting the ladder, and a removable shelf.

U.S. Pat. No. 6,533,071

Inventor: Winston Smith

Issued: Mar. 18, 2003

A ladder with an incorporated pair of stabilizers. Each stabilizer comprises a base leg and an adjustable leg. Each adjustable leg is pivotally mounted on a side of the ladder, with the adjustable leg having a plurality of holes over its length. The base leg slides on a track within the adjustable leg and can be set to a specific length. An additional locking means is provided to temporarily lock the adjustable leg to the side of the ladder while in use.

European Patent Number EP0039078

Inventor: Adam Klenk

Issued: Apr. 27, 1981

A stepladder, consisting of a ladder portion which comprises rungs and includes two ladder side rails and of a support portion which includes two support side rails the upper ends of which are connected in articulated fashion to the upper ends of the ladder side rails, and of four links the outer ends of which are pivoted to one each of the four side rails and the inner ends of which are connected in pairs by a joint, thereby limiting the angle of opening between the ladder portion and the support portion, and of two ladder props adapted to be swung out laterally in opposite directions in the central plane of the ladder and pivoted in the area of the upper side rail ends, and of two spreader bars which are connected at their respective inner ends to a pair of links and at their outer ends to either one of the two ladder props, with their axes extending parallel to the pivot axis of each ladder prop so as to permit the automatic swinging out and in of the two ladder props upon opening and closing, respectively, of the stepladder, characterized in that the links are pivoted at the outside of the side rails, extend at right angles with respect to their own pivot axes, and, in pairs, interconnect a ladder side rail and a support side rail, and in that one of the two spreader bars each is pivotably connected at its inner end to the two joints.

WIPO Patent Publication Number WO 00/32900

Inventor: Horst Laug

Published: Jun. 8, 2000

Length-adjustable stabilizers are arranged on the side rails of a ladder. Said stabilizers can be folded inwards, parallel to the ladder. Two length-adjustable diagonal ties and struts are provided in order to prevent the stabilizers from slipping when folded out.

While these extension and stepladders may be suitable for the purposes for which they were designed, they would not be as suitable for the purposes of the present invention, as hereinafter described.

SUMMARY OF THE PRESENT INVENTION

The present invention discloses a stepladder having a ladder portion that is comprised of rungs and includes two ladder side rails, and a support portion that includes two angularly disposed telescoping legs that provide means for stabilizing the ladder. The telescoping support legs are interconnected to each other and to the ladder side rails by lockable rigid spanner arms. When in use, the spanner arms are locked in an open position providing means to form a tripod formation between the rails while additionally limiting the angle of spread between the ladder portion and the support legs. The present invention also provides a retractable fly assembly at the top of the ladder rails to provide means for additional usable working height. A safety belt is provided on the handle for additional support. A series of apertures with lock key fasteners in each of the support legs provide means for the user to securely position the legs at a desired length. The lock key fastener includes a locking pin that engages an aperture in the corresponding leg to secure the desired position.

A primary object of the present invention is to provide a stepladder having legs forming a triangular shape on the floor when extended.

Another object of the present invention is to provide a stepladder having pivotal legs divergently movable to a triangular shaped position having rigid member between the adjacent members.

Yet another object of the present invention is to provide the said stepladder having a base section extending into a fly section at the apex of said ladder.

Still yet another object of the present invention is to provide a stepladder with leveling and stabilizing means for use on uneven surfaces.

Another object of the present invention is to provide a stepladder with means to adjust the height of the fly section to accommodate reach requirements.

Still yet another object of the present invention is to provide a stepladder with locking keys that engage mating apertures to secure ladder position.

Another object of the present invention is to provide a stepladder with a retractable handle at the apex of the ladder fly section to provide additional usable working height at a given package size.

Yet another object of the present invention is to provide a stepladder with independent telescoping support rails.

Still yet another object of the present invention is to provide a stepladder having legs to (nearly) parallel position and relatively shorter length for a smaller storage package.

Another object of the present invention is to provide a stepladder having a safety belt to prevent falls.

Additional objects of the present invention will appear as the description proceeds.

The present invention overcomes the shortcomings of the prior art by providing means for telescopic adjustment of both support rails that form a tripod formation that in turn allows a user to adjust the ladder height, stabilize and level the stepladder for use on both an even and uneven surface.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
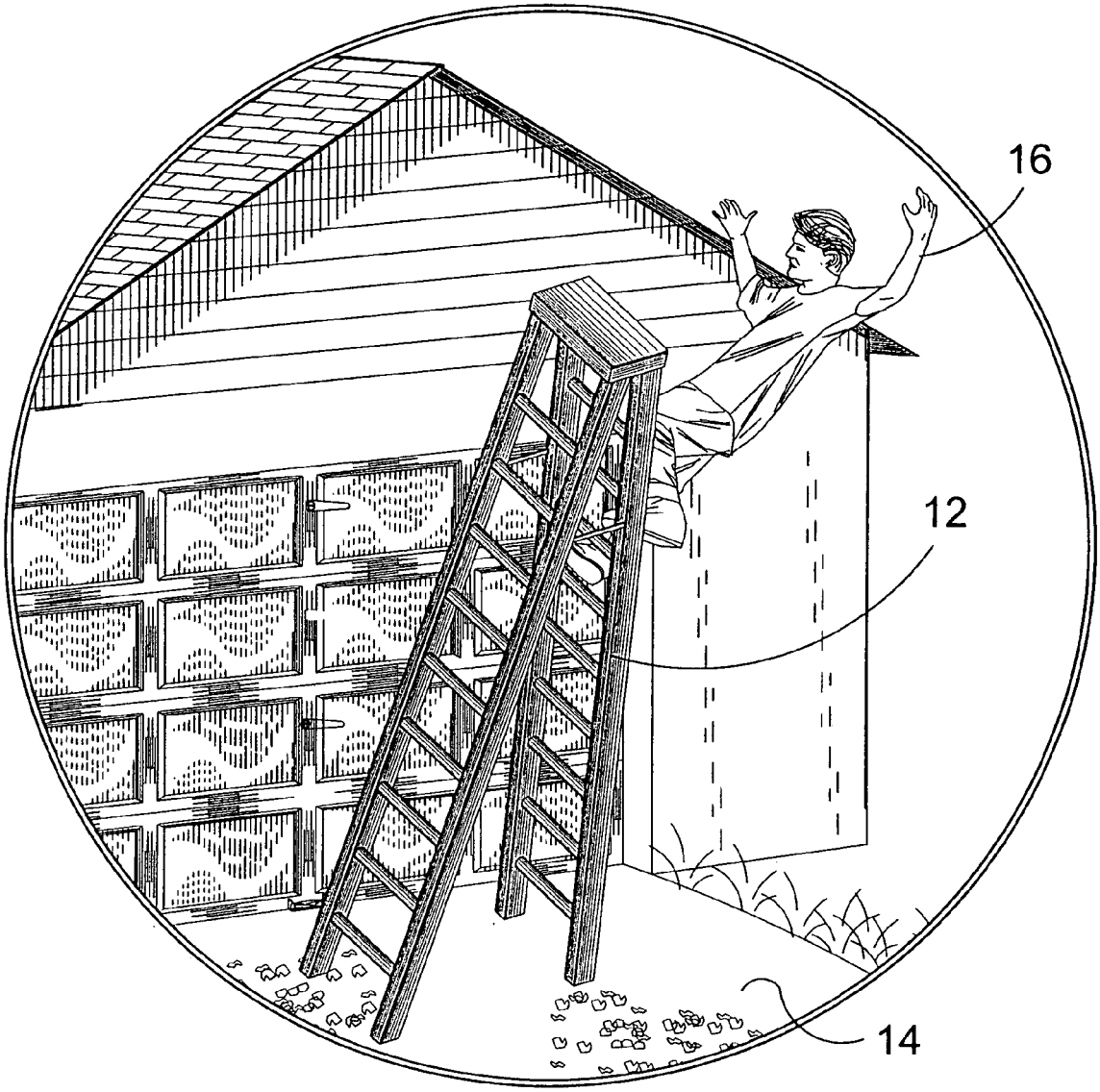
FIG. 1 ( PRIOR ART )
FIG. 1 is an illustrative view of a prior art stepladder in use.

With regard to reference numerals used, the following numbering is used throughout the drawings.

10 present invention
12 conventional stepladder
14 unlevel surface
16 user
18 ladder portion
20 support legs
22 spanner
24 rungs
26 fly assembly
28 lock keys
30 platform
32 top cap
34 hand rail
36 safety belt
38 inner telescopic leg
40 bracket
42 fastener
44 weld
46 bracket
48 pivot
50 outer leg

DETAILED DESCRIPTION OF THE PREFERRED EMBODIMENT

The following discussion describes in detail one embodiment of the invention. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of a prior art stepladder in use. Shown is a conventional stepladder 12 being used on an unlevel sloped surface 14. When a conventional ladder 12 is used on an unlevel sloped surface 14, it typically becomes unbalanced and prone to tipping, presenting a safety hazard to the user 16. The present invention overcomes the shortcomings of the prior art 12 by eliminating this potentially deadly hazard and providing additional features advantageous to the user 16.

Figure 2:
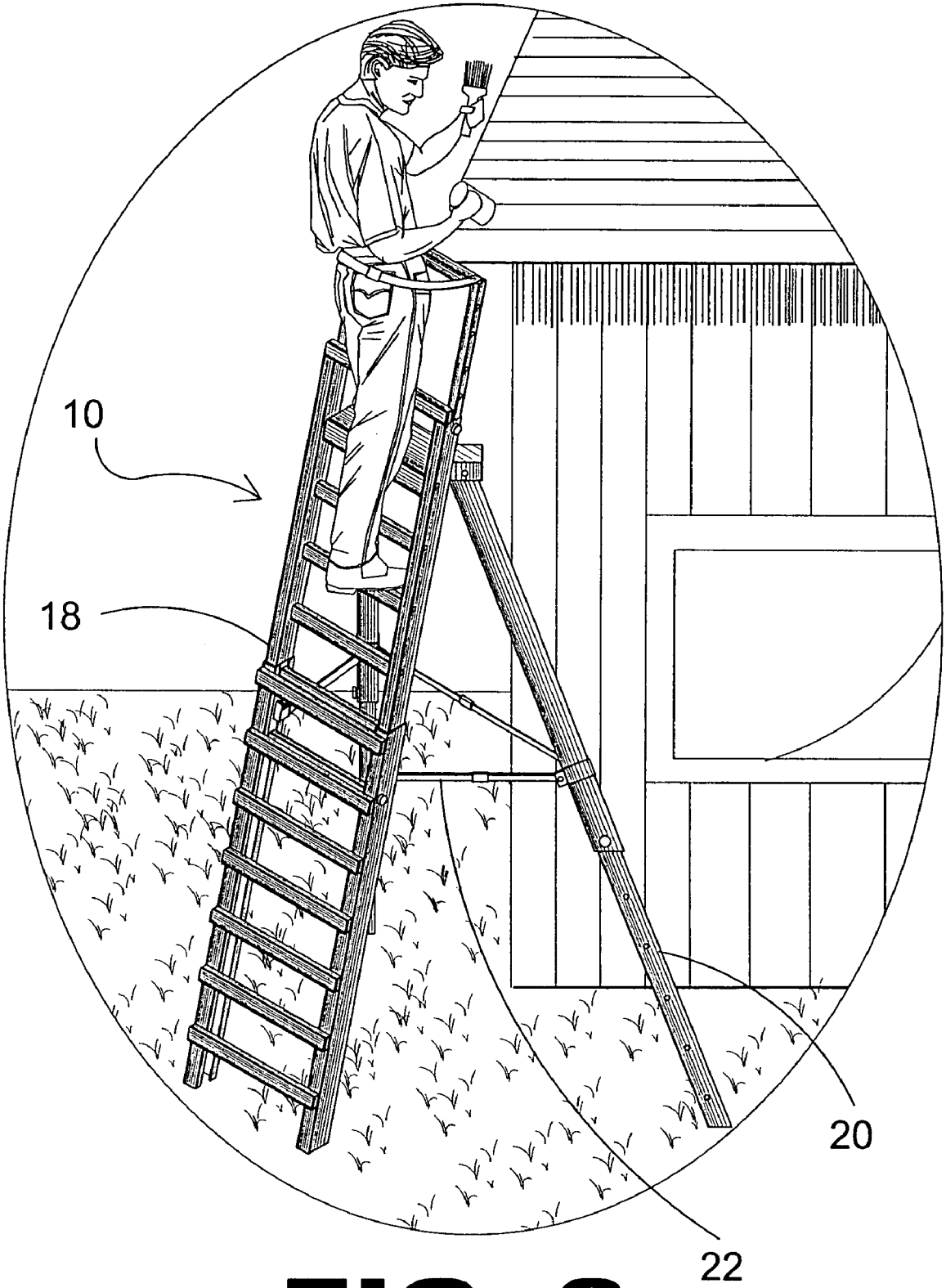
FIG. 2 is an illustrative view of the present invention in use.

Turning to FIG. 2, shown therein is an illustrative view of the present invention 10 in use. Shown is a tripod stepladder comprising a ladder section 18 with divergently extending support legs 20 pivotally attached thereto with rigid spanners 22 extending from the ladder section to each of the support legs and also between the support legs, thereby preventing movement of the members when in the open position. Furthermore, each of the support legs 20 is independently telescopic to accommodate any base surface grade. The support legs 20 are angularly disposed therein-between a greater distance than the width of the ladder section 18, thereby forming a tripod support base having an improved side to side stability that is not currently available.

Figure 3:
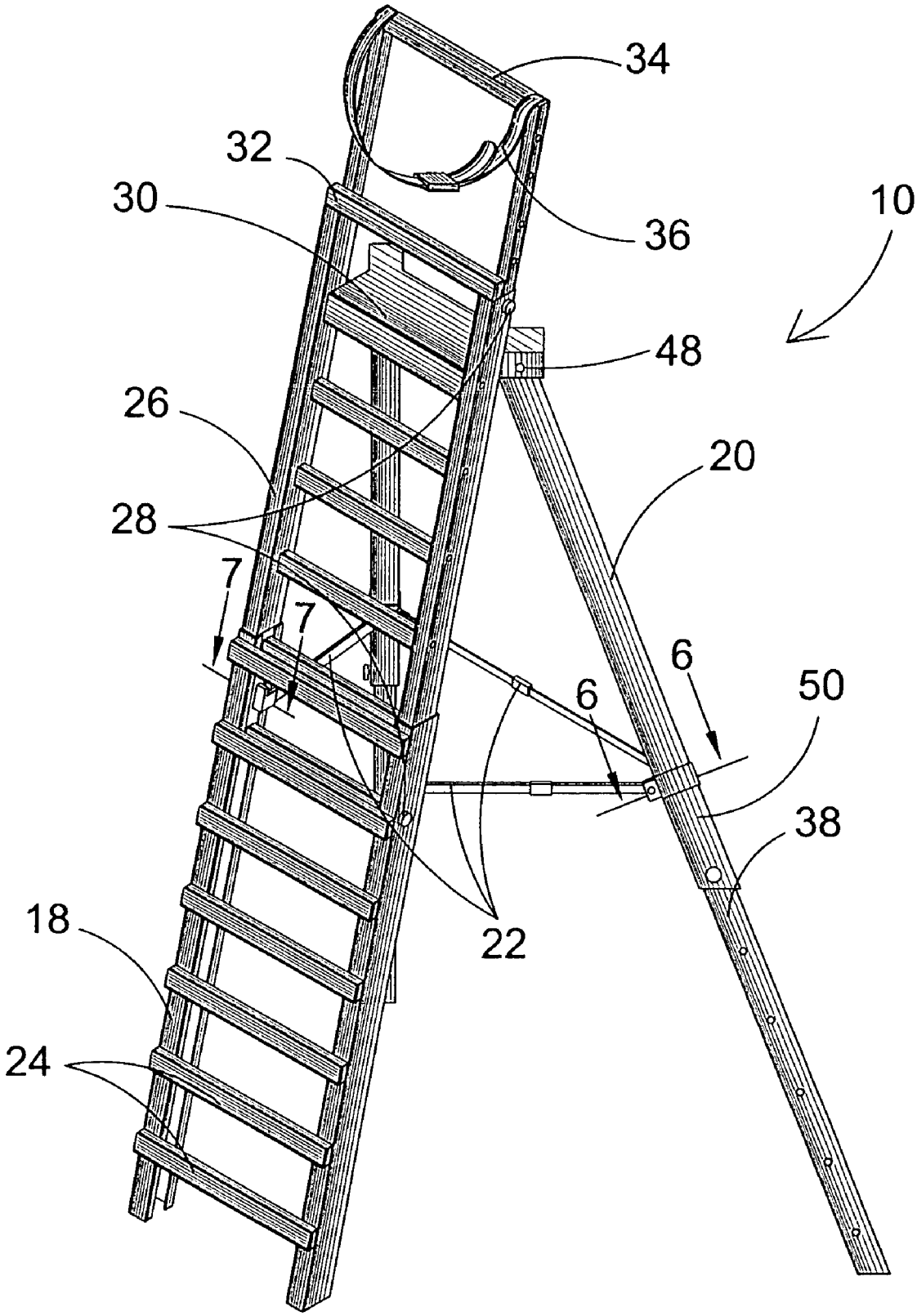
FIG. 3 is a perspective view of the present invention in its fully unfolded and extended configuration.

Turning to FIG. 3, shown therein is a perspective view of the present invention 10 in its fully unfolded and extended configuration. Shown is the present invention 10 in the open position whereby the user is provided with a tripod stepladder having means for setting to a desired height along with the improved stability features that allow the user to extend the telescopic support legs 20 to a user selected position that places the support legs at a width far exceeding the typical width of the ladder base assembly portion 18 providing a side to side stability not currently available. In addition, the support legs 20 angular inclination is fixed by multiple, rigid spanners 22 forming structurally integral tripod support members. Also shown are rungs 24, ladder fly assembly 26, adjustment lock keys 28, platform 30 with pivot 48 for connecting support leg 20, top cap 32, hand rail 34, safety belt 36, and inner extendable portion 38 and outer 50 portion of leg 20.

Figure 4:
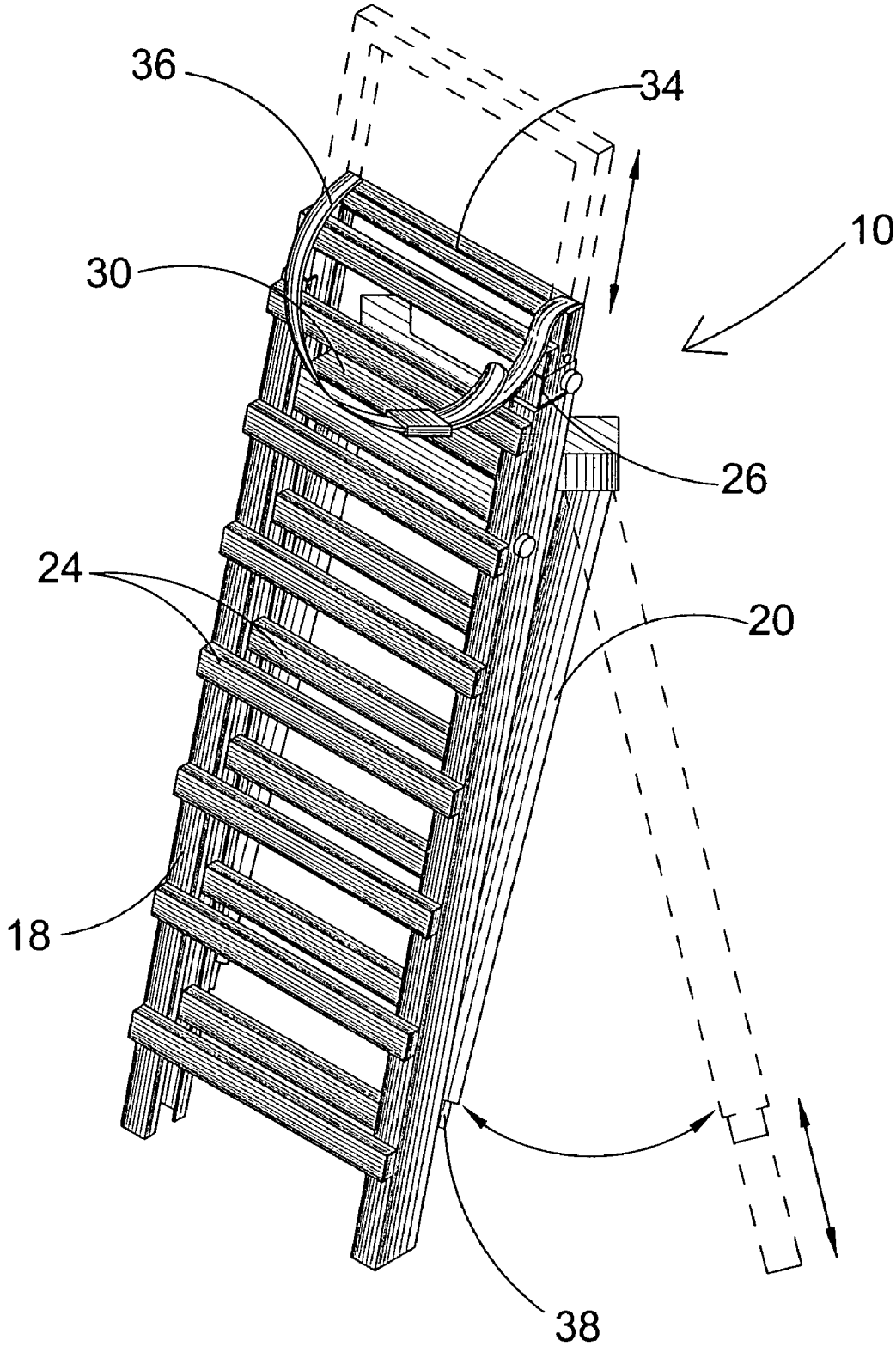
FIG. 4 is a perspective view of the present invention in its folded configuration.

Turning to FIG. 4, shown therein is a perspective view of the present invention 10 in its folded configuration. Shown is the present invention 10 in its retracted position depicting the unfolding and the extendible telescopic properties of the various ladder assemblies and support rails. The user may use the present invention 10 as a tripod stepladder in an unextended position providing a lower overall standing height while still providing an improved stable base. Additionally shown is the present invention 10 in the retracted position making it easily transportable and storable. Other previously disclosed elements are also shown.

Figure 5:
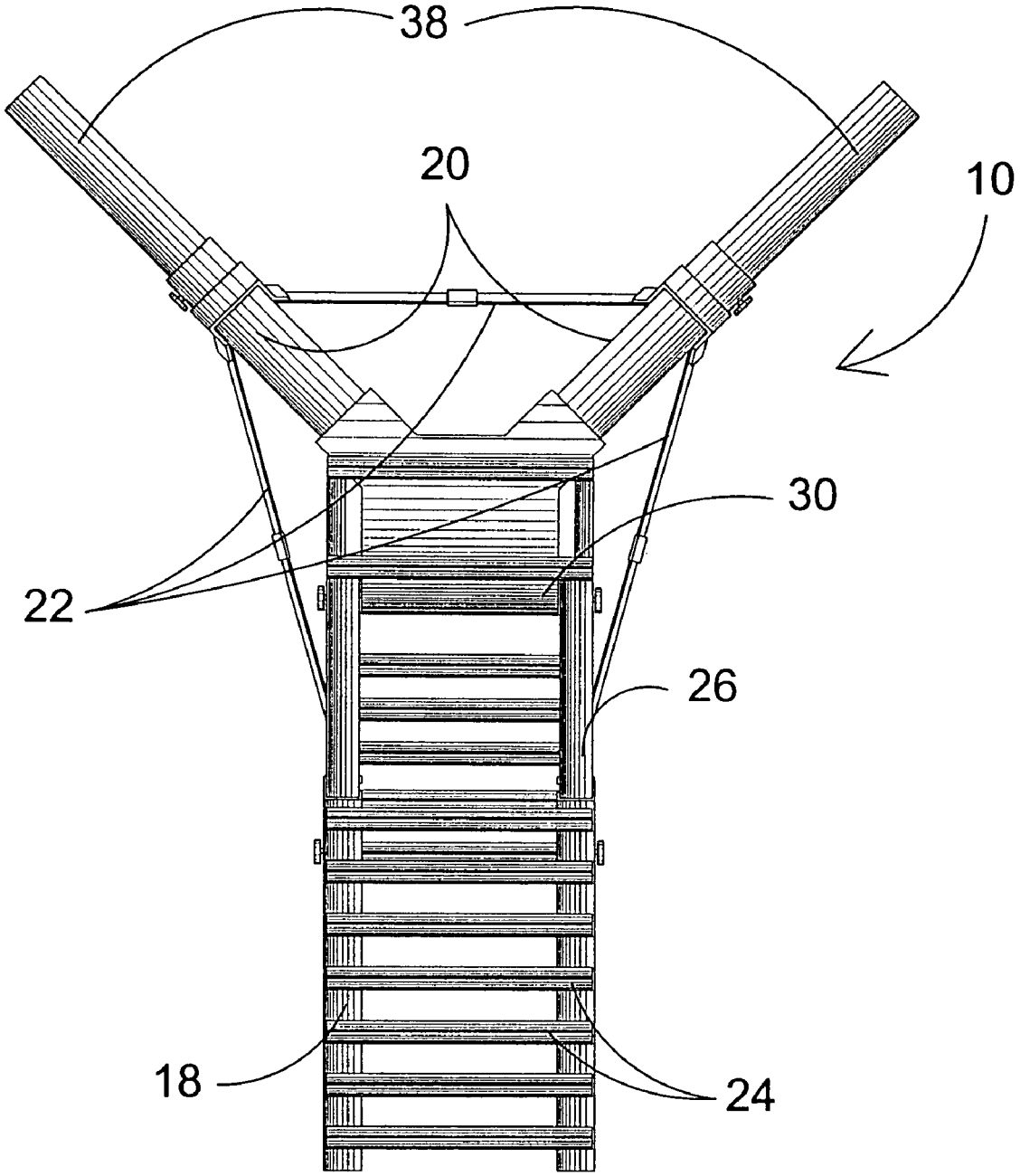
FIG. 5 is a top view of the present invention in its extended configuration.

Turning to FIG. 5, shown therein is a top view of the present invention 10 in its extended configuration. Shown is the present invention 10 providing a means for improved safety and convenience by utilizing the stability of a tripod employed in a stepladder having angularly divergent support members 20 confined to a predetermined angle by rigid spanners 22 extending between the support legs and ladder section 18 creating a side to side stability not currently available. As illustrated, the angular divergence between legs 20 is greater than the width of the ladder section 18. Also shown, are individually telescopic legs 38 providing means for compensating placement on a surface that is sloped or uneven. Other previously disclosed elements are also shown.

Figure 6:
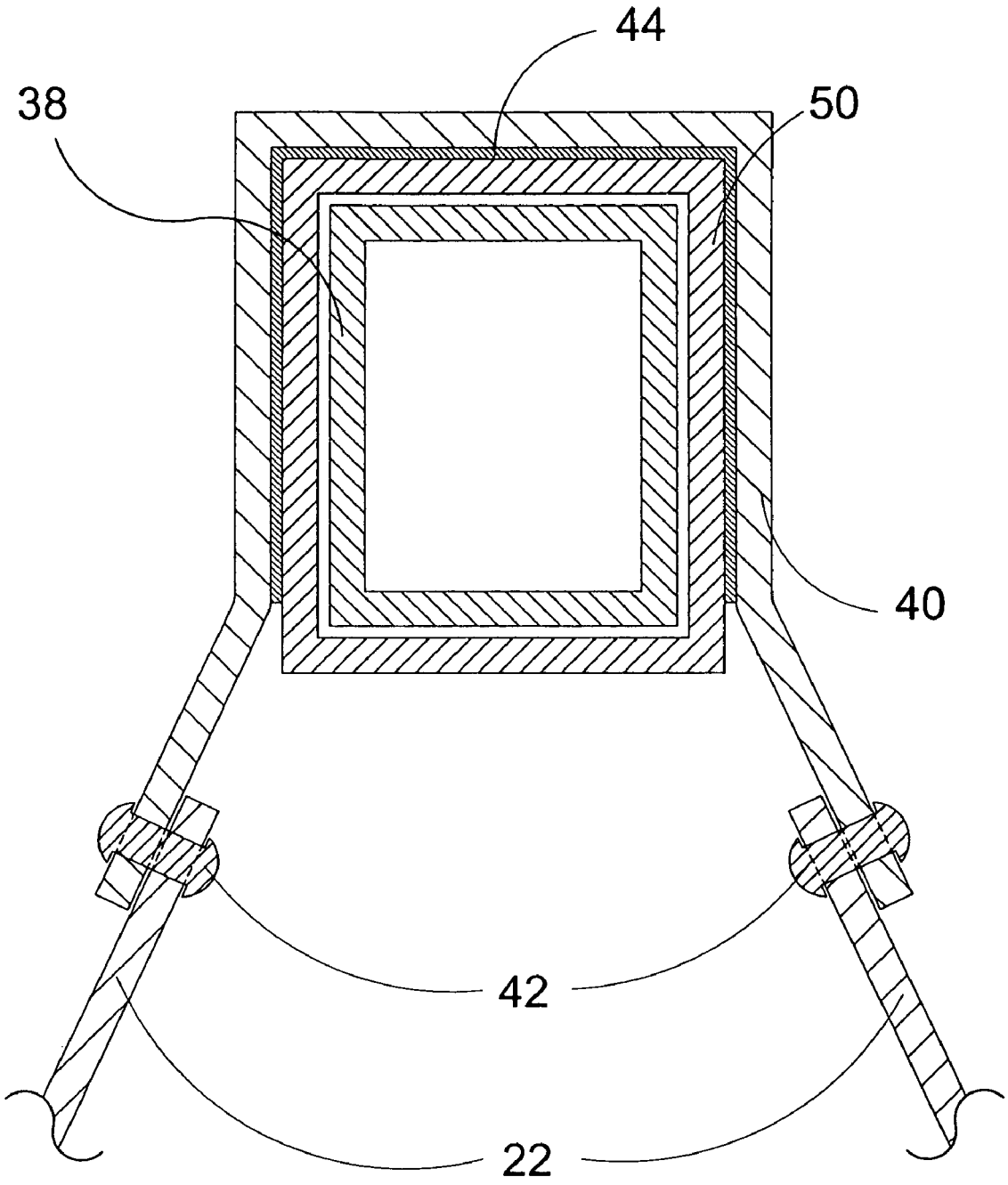
FIG. 6 is a cross sectional view of the spanner anchor bracket at the support legs.

Turning to FIG. 6, shown therein is a cross sectional view of the spanner anchor bracket 40 at the outer support leg 50. Shown is a cross sectional view of the spanner bracket 40, taken from FIG. 3 as indicated. Shown are the spanners 22 of the present invention and the means by which they connect to the outer support leg 50. The spanners 22 connect to a bracket 40 fixedly attached with a weld 44 to the exterior surface of the outer support leg 50. The spanner 22 is fastened to the bracket 40 by means of a fastener 42 whereby the spanner is pivotally connected thereto. Also shown is inner telescopic leg 38.

Figure 7:
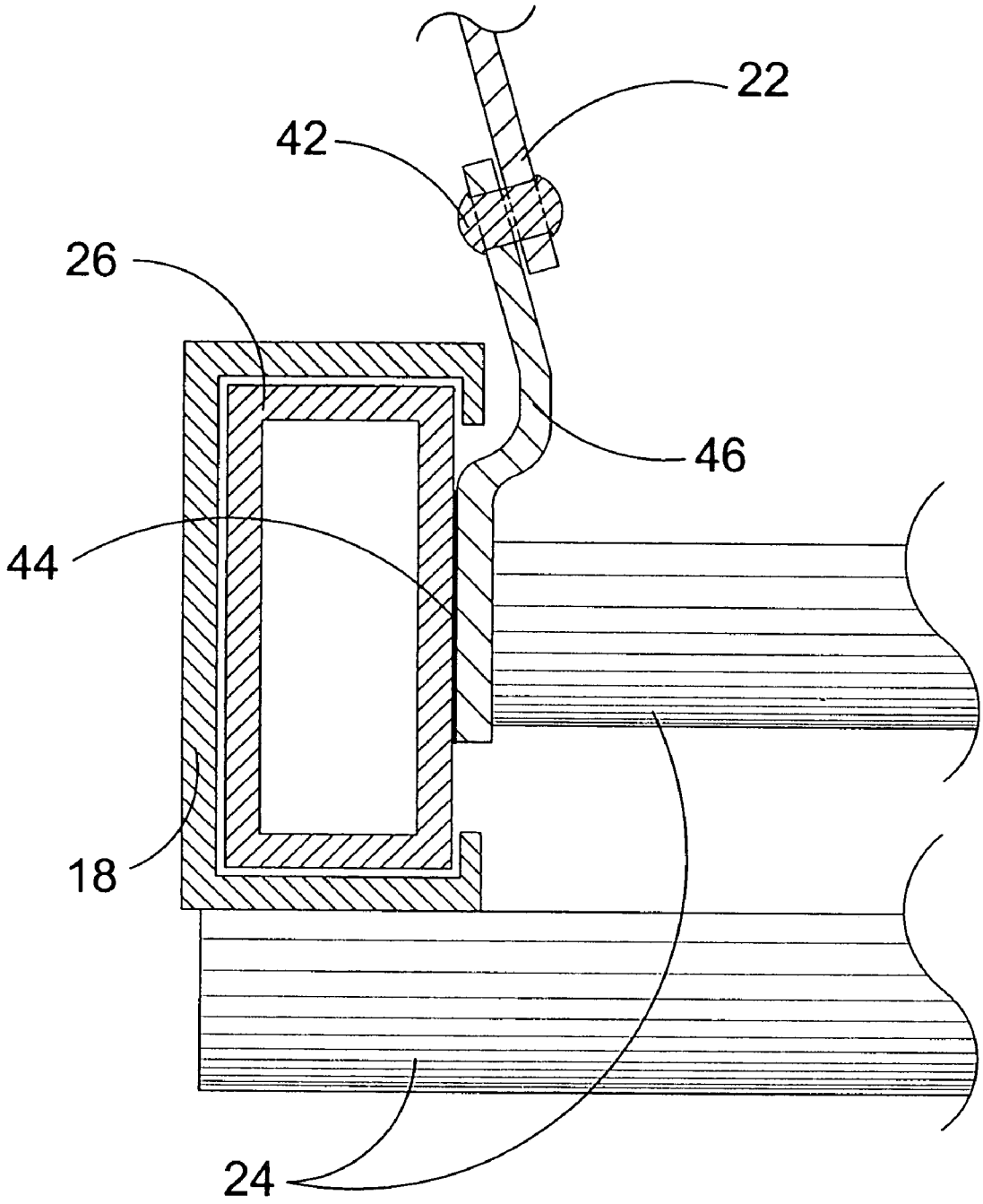
FIG. 7 is a cross sectional view of the spanner anchor bracket at the ladder fly assembly.

Turning to FIG. 7, shown therein is a cross sectional view of the spanner 22 and ladder fly assembly 26 of the present invention. Shown is the spanner 22 connection to the ladder section, taken from FIG. 3 as indicated. A spanner 22 is fastened to a bracket 46 fixedly attached to the ladder section, such as welded at 44. The spanner 22 is connected by means of a fastener 42 whereby the spanner is pivotal. Another spanner bracket is attached to the ladder opposing side. In conjunction with the support leg spanner brackets 46, means is provided for creating an integrally rigid tripod support frame for maintaining the angular divergence of the support legs and an enhanced side to side stability. Also shown are ladder portion 18 and rungs 24.

Figure 8:
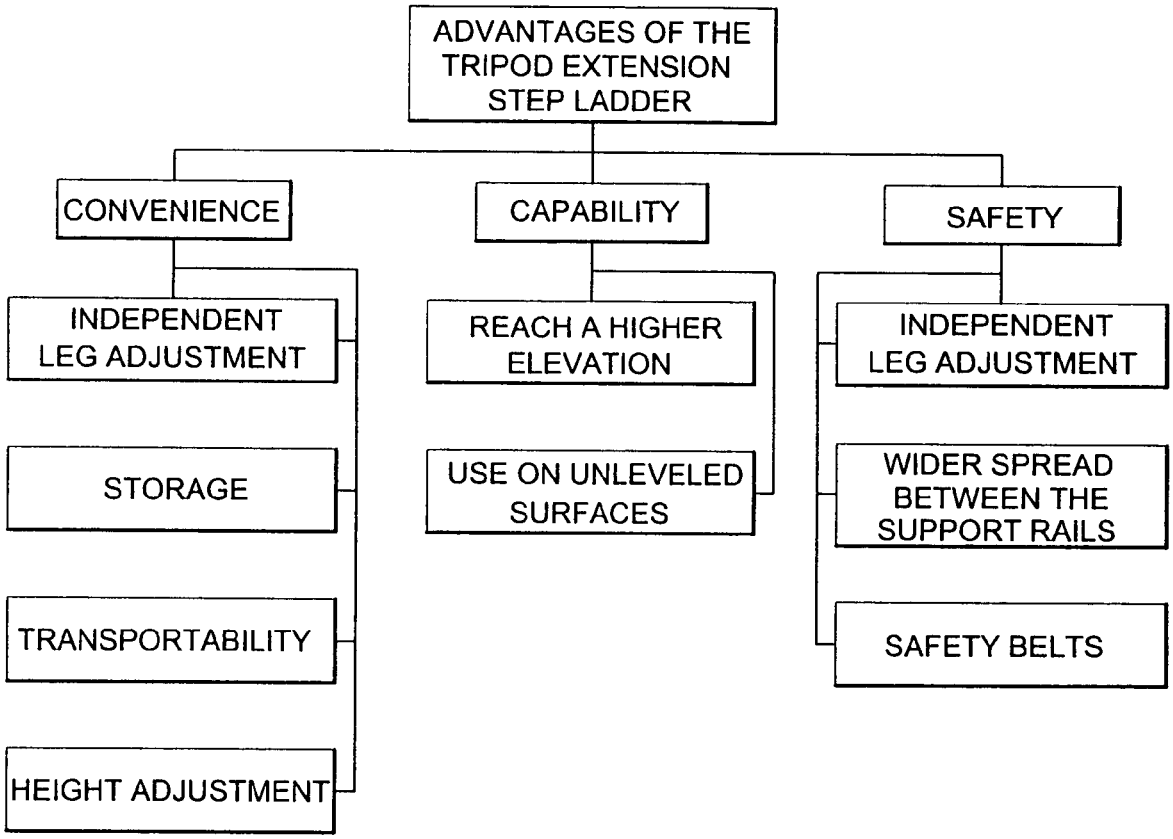
FIG. 8 is a block diagram of the advantages of the present invention.

Turning to FIG. 8, shown therein is a block diagram of the advantages of the present invention. Shown is a block diagram depicting the advantages of the present invention that overcome the shortcomings of a conventional stepladder.

Figure 9:
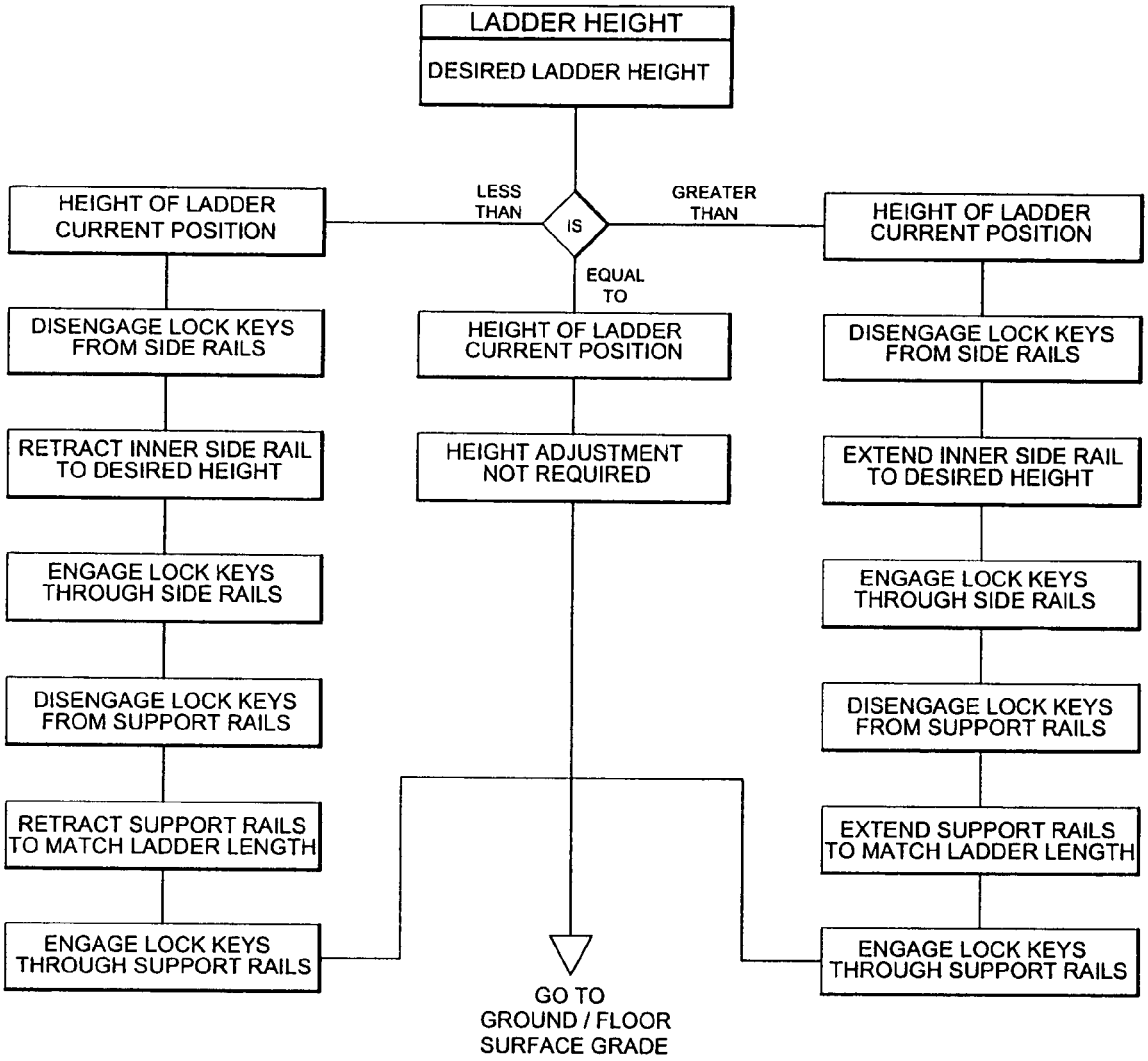
FIG. 9 is a flowchart of the present invention.

Turning to FIG. 9, shown therein is a flow chart of the present invention. Shown is a flow chart of the present invention depicting the logic sequence by which the user should operate the present invention to successfully adjust the present invention's height to a proper level. Additionally, lock keys provide for the release and securement of user selected extension and retraction positions.

Figure 10:
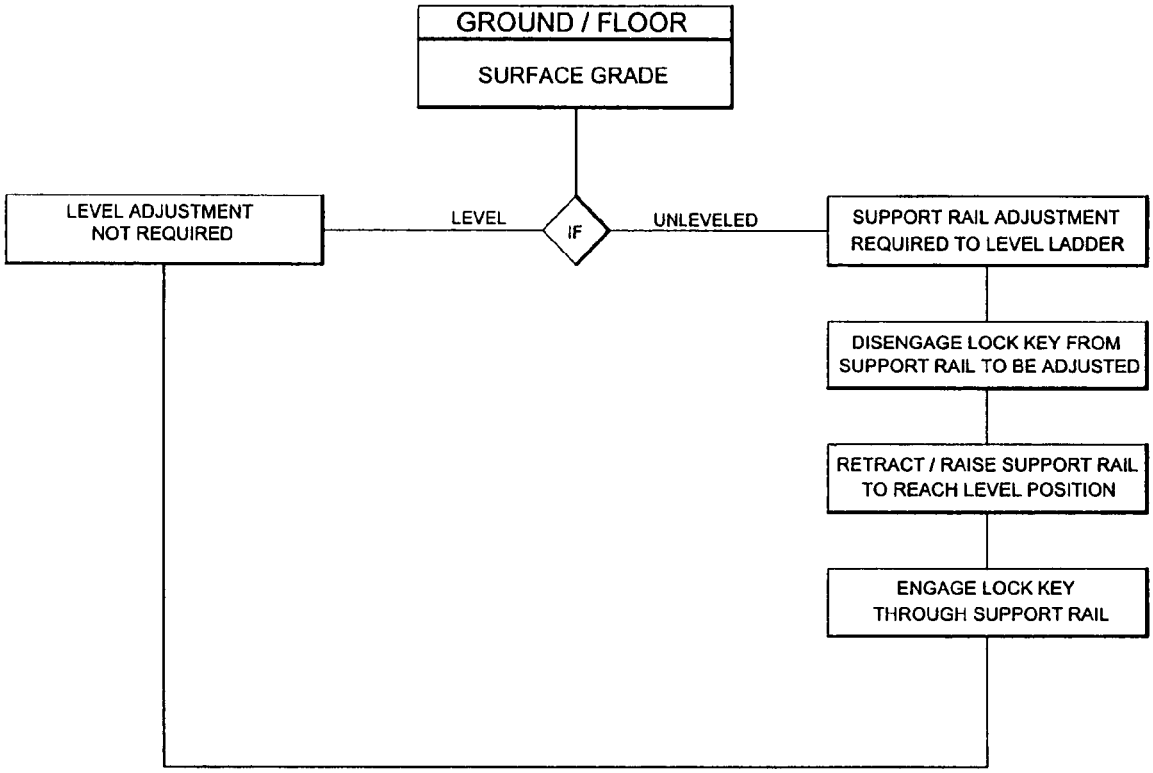
FIG. 10 is a flow chart of the present invention.

Turning to FIG. 10, shown therein is a flow chart of the present invention. Shown is a flow chart of the present invention depicting the methods by which the user may level the present invention.

What is claimed to be new and desired to be protected by Letters Patent is set forth in the appended claims.

I claim:

1. An apparatus for providing an extendable stepladder having a pair of support legs, comprising:

a) a stepladder portion having first and second side rails having a plurality of rungs extending therein between, an upper and tower end, wherein each said side rail has a throughbore therein;

b) first and second support legs adapted for pivotal connection to said upper end of said stepladder portion, said support legs having upper and lower ends, wherein said support legs are divergently angularly disposed with respect to said stepladder portion, wherein said legs are divergently angularly disposed with respect to each other; and, c) first, second and third spanner supports adapted for pivotal connection between said stepladder portion and said pair of support legs, each of said first, second and third spanner supports having first and second ends, wherein said first spanner support is disposed between said first side rail and said first support leg, wherein said second spanner support is disposed between said second side rail and said second support leg, wherein said third spanner support is disposed between said first and second support legs, d) wherein said support legs are telescopic to permit the length to be adjusted, e) an extendable ladder portion being disposed on said upper end of said stepladder portion to permit the stepladder to be extended, said extendable ladder portion having first and second side rails having a plurality of rungs extending therein between, an upper and lower end, wherein each said side rail has a throughbore therein, f) wherein each said side rail of said extendable ladder portion is slidably, fixedly disposed in said throughbore of each of said corresponding side rail of said stepladder portion to permit the extendable ladder portion to be extended above the stepladder portion, and g) an extendable hand rail portion being disposed on said upper end of said extendable ladder portion to permit the extendable hand rail portion to be extended, said extendable hand rail portion having first and second side rails and a hand rail extending therein between, an upper and lower end, wherein said hand rail is disposed on said upper end of said extendable hand rail portion to permit a user to grip the hand rail for stability.

2. The apparatus of claim 1, wherein each said side rail of said extendable hand rail portion is slidable fixedly disposed in said throughbore of each said corresponding side rail of said extendable ladder portion to permit the extendable hand rail portion to be extended above the extendable ladder portion.

3. The apparatus of claim 2, further comprising a top cap being disposed on said upper end of said extendable ladder portion, said top cap extending between said first and second side rails of said extendable ladder portion.

4. The apparatus of claim 3, further comprising a safety belt being disposed on said extendable hand rail portion to permit a user to be strapped to the extendable hand rail portion.

5. The apparatus of claim 4, further comprising a platform being disposed on said upper end of said extendable ladder portion to permit articles to be placed on the platform and provide highest standing position.

6. The apparatus of claim 5, wherein said first and second support legs are pivotally connected to said platform.

7. The apparatus of claim 6, wherein each said upper end of said first and second side rails of said stepladder portion has a first aperture therein, wherein each said first and second side rail of said extendable ladder portion has a plurality of spaced apart second apertures therein, wherein one of said second apertures can be matingly aligned with said first apertures for receiving a first locking pin therein so that said extendable ladder portion can be slidingly fixed to said stepladder portion.

8. The apparatus of claim 7, wherein each said upper end of said first and second side rails of said extendable ladder portion has a third aperture therein, wherein each said first and second side rail of said extendable hand rail portion has a plurality of spaced apart fourth apertures therein, wherein one of said fourth apertures can be matingly aligned with said third apertures for receiving a second locking pin therein so that said extendable hand rail portion can be slidingly fixed to said extendable ladder portion.

9. The apparatus of claim 8, wherein each said support leg further comprises an inner telescopic leg portion which telescopes within an outer leg portion, wherein each said outer leg portion of said support leg has a fifth aperture therein, wherein each said inner leg portion has a plurality of spaced apart sixth apertures therein, wherein one of said sixth apertures can be matingly aligned with said fifth aperture for receiving a third locking pin therein so that said inner leg portion can by slidingly fixed to said outer leg portion.

10. The apparatus of claim 9, wherein said first, second and third spanner supports fold so that said support legs can be stored contiguous to said stepladder portion of the apparatus.

11. The apparatus of claim 10, further comprising a plurality of brackets adapted for connection of said first and second ends of said spanner supports to said stepladder portion and said support legs.

12. The apparatus of claim 11, wherein when said stepladder is fully open, the span between the support legs on the floor is significantly larger than the ladder width and when the stepladder is closed, the span between the support legs on the floor is decreased by changing the angle between the two legs so that the support leg span is nearly the same as the ladder width.

* * * * *